US010751565B2

(12) United States Patent
Saadallah

(10) Patent No.: US 10,751,565 B2
(45) Date of Patent: Aug. 25, 2020

(54) EXERCISE MACHINE

(71) Applicant: Fadi Saadallah, Pully (CH)

(72) Inventor: Fadi Saadallah, Pully (CH)

(73) Assignee: Fadi Saadallah, Pully (CH)

( * ) Notice: Subject to any disclaimer, the term of this patent is extended or adjusted under 35 U.S.C. 154(b) by 18 days.

(21) Appl. No.: 16/329,085

(22) PCT Filed: Aug. 28, 2016

(86) PCT No.: PCT/IB2016/055136
§ 371 (c)(1),
(2) Date: Feb. 27, 2019

(87) PCT Pub. No.: WO2018/042217
PCT Pub. Date: Mar. 8, 2018

(65) Prior Publication Data

US 2019/0224524 A1 Jul. 25, 2019

(51) Int. Cl.
*A63B 23/035* (2006.01)
*A63B 21/00* (2006.01)
(Continued)

(52) U.S. Cl.
CPC .. *A63B 23/03566* (2013.01); *A63B 21/00061* (2013.01); *A63B 21/00065* (2013.01);
(Continued)

(58) Field of Classification Search
CPC ..... A63B 23/03566; A63B 23/0355; A63B 23/0411; A63B 23/1236; A63B 23/1218;
(Continued)

(56) References Cited

U.S. PATENT DOCUMENTS 5,738,611 A 4/1998 Ehrenfried et al.
5,993,362 A 11/1999 Ghobadi
(Continued)

FOREIGN PATENT DOCUMENTS

WO 2013009749 A1 1/2013
WO 2016033589 A1 3/2016

OTHER PUBLICATIONS

International Search Report; European Patent Office; International Application No. PCT/IB2016/055136; dated May 4, 2017; 4 pages.
(Continued)

*Primary Examiner* — Loan B Jimenez
*Assistant Examiner* — Thao N Do
(74) *Attorney, Agent, or Firm* — Taft Stettinius & Hollister LLP

(57) ABSTRACT

The present invention relates to a multi-gym machine which enables a user to perform a plurality of different exercises for the whole body. More specifically the present invention relates specifically to a power tower machine in which the user utilizes a combination of the user body weight (calisthenics) in addition to variable elastic bands to provide additional assistance or resistance.
This advanced power tower hereby disclosed incorporates an arrangement of multiple handles, various pulleys, elastic cables and steel wire connected to a special waist belt to be put on by the user. The elastic cables depending on their anchor points either from the top or the bottom pulley, generates assistance or resistance to the user respectively for the specific workout. A set of sensors, processor and Bluetooth transmission unit is integrated on the power tower to process, transmit, process and manage several workouts performance indicators via a dedicated mobile application offering a virtual coaching capabilities.
(Continued)

Also with internet connection, the mobile application offers an IoT (Internet of Things) concept enable virtual competition with other users using the same machine and mobile application.

15 Claims, 8 Drawing Sheets

(51) Int. Cl.

| | |
|---|---|
| ***A63B 21/078*** | (2006.01) |
| ***A63B 23/12*** | (2006.01) |
| ***A63B 21/055*** | (2006.01) |
| ***A63B 21/04*** | (2006.01) |
| ***A63B 21/072*** | (2006.01) |
| ***A63B 23/02*** | (2006.01) |
| ***A63B 24/00*** | (2006.01) |
| ***A63B 23/04*** | (2006.01) |

(52) U.S. Cl.

CPC .... *A63B 21/00181* (2013.01); *A63B 21/0428* (2013.01); *A63B 21/0442* (2013.01); *A63B 21/0552* (2013.01); *A63B 21/0555* (2013.01); *A63B 21/0557* (2013.01); *A63B 21/078* (2013.01); *A63B 21/0724* (2013.01); *A63B 21/154* (2013.01); *A63B 21/4009* (2015.10); *A63B 21/4013* (2015.10); *A63B 21/4043* (2015.10); *A63B 21/4045* (2015.10); *A63B 23/0211* (2013.01); *A63B 23/0355* (2013.01); *A63B 23/1209* (2013.01); *A63B 23/1218* (2013.01); *A63B 23/1227* (2013.01); *A63B 23/1236* (2013.01); *A63B 24/0062* (2013.01); *A63B 2023/0411* (2013.01); *A63B 2209/00* (2013.01); *A63B 2209/10* (2013.01); *A63B 2220/17* (2013.01); *A63B 2220/20* (2013.01); *A63B 2220/30* (2013.01); *A63B 2220/51* (2013.01); *A63B 2220/56* (2013.01); *A63B 2220/803* (2013.01); *A63B 2225/09* (2013.01); *A63B 2225/102* (2013.01); *A63B 2225/50* (2013.01)

(58) Field of Classification Search

CPC ..... A63B 23/1227; A63B 2225/102; A63B 2220/20; A63B 2220/51; A63B 2220/56; A63B 21/4043; A63B 21/4013; A63B 21/078; A63B 21/0724; A63B 21/00181

USPC ..... 482/8

See application file for complete search history.

(56) References Cited

U.S. PATENT DOCUMENTS

| | | | | |
|---|---|---|---|---|
| 2003/0027696 | A1* | 2/2003 | Baumler | A63B 21/4047 482/99 |
| 2006/0160677 | A1* | 7/2006 | Piane, Jr. | A63B 23/1209 482/101 |
| 2008/0182735 | A1 | 7/2008 | Thomas | |
| 2010/0173759 | A1* | 7/2010 | Lalaoua | A63B 71/0619 482/121 |
| 2010/0197462 | A1* | 8/2010 | Piane, Jr. | A61B 5/22 482/5 |
| 2011/0177921 | A1* | 7/2011 | Olson | A63B 21/4013 482/92 |
| 2012/0108403 | A1 | 5/2012 | Zandman-Zeman | |
| 2013/0035220 | A1 | 2/2013 | Adams | |
| 2013/0184128 | A1* | 7/2013 | Towley, III | A63B 21/156 482/102 |
| 2013/0274075 | A1* | 10/2013 | Habing | A63B 21/078 482/102 |
| 2014/0005015 | A1* | 1/2014 | Hester | A63B 21/4035 482/131 |
| 2014/0155229 | A1 | 6/2014 | Nikkaran | |
| 2016/0059061 | A1 | 3/2016 | Lagree et al. | |

OTHER PUBLICATIONS

Written Opinion of the International Searching Authority; European Patent Office; International Application No. PCT/IB2016/055136; dated May 4, 2017; 7 pages.

* cited by examiner

The angular movement is computed to give the stroke movement and therefore indicates the beginning and the end of any exercise.

#Reps
#Sets
#Rest time

EXERCISE MACHINE

CROSS REFERENCE TO RELATED APPLICATIONS

This application is a U.S. national stage filing of International Patent Application No. PCT/M2016/055136 filed Aug. 28, 2016, the contents of which are hereby incorporated by reference in their entirety.

BACKGROUND

Field of the Invention

The present invention relates to an item of multi-gym machine which enables a user to perform a plurality of different exercises for the whole body. More specifically, the present invention relates to a multi-gym machine and specifically to a power tower multi-gym machine in which the user may selectively utilize a combination of the user weight (calisthenics) in addition to variable resistance elastic bands to provide a load against which the person exercises in one direction or provide a support to the user by lifting the user weigh from the other direction. The resistance/support varies the load simply by changing the elastic bands.

Description of the Related Art

Various types of exercise apparatus have been proposed.

Some gym machines for strength training have utilized a weight stack in conjunction with a cable and multiple pulley system, known as cross over cable machines, to provide resistance to an exercise motion.

However, because each machine only trains limited body parts, a large number of machines are required to train an entire body.

Other machines, rather a chassis, called power towers, only utilize the user's weight to perform wider ranges of exercise. The drawback of these callisthenic concept structures is the difficulty the beginner user is facing to lift their own weight and perform correctly the exercises. We have seen recently in the market standalone elastic bands added to the structure to perform only pullups and chin-ups exercises.

Other machines for strength training combine the concept of using multiple, specialized machines utilizing cable exercises into a single machine that has adjustable loads using weight stacks. The disadvantages of these machines is that the exercise stations linked to one resistance load will increase the length of cable between the exercise station and the load. Excessive cable length will therefore take away the smoothness of some exercise movements because of cable stretching.

Other more advanced machines combine the concept of using the above mentioned concept by using different means of adjustable loads using different types of resistance as elastic rods, elastic cables, springs as a replacement of the above mentioned weight stack.

These machines are obliged to change the machine geometrical configuration by varying the various arms and angles to allow for a number of exercises on the single machine.

Although these machines eliminate the size constraint of cable cross over machines and the need to have multiple specialized machines, they can be difficult to adjust, create exercises that are not very intuitive, and require time away from training to make adjustments to the machine.

The above types of machines are intended for use by people who have experience in body building exercise, are in good health and wish to improve their physical condition. However, they are usually not suited for beginners, the elderly and disabled people.

For home or small gym use, where size limitations, cost constraints, and complexity issues exist, it is advantageous to combine the above-described training methods into a single machine that is relatively simple to operate.

Therefore, there is a need then for exercise equipment which is simple, robust, allows a good variety of different exercises to be performed by using both user weigh and elastic cables as means of additional load or support, readily adjustable, and intuitive. Moreover, in the era of the advanced mobile application in general and especially in the field of fitness, there is a need to create an optimal modern of a synergy between the physical structure of the apparatus, and a mobile application.

SUMMARY

The purpose and advantages of the invention will be set forth in, and apparent from, the description and drawings that follow, as well as will be learned through practice of the invention. Additional advantages of the invention will be realized and attained by the elements of the apparatus and methods of using the invention described herein. Simplifications or omissions may be made to avoid obscuring the purpose of the section. Such simplifications or omissions are not intended to limit the scope of the present invention.

In accordance with one aspect of the present invention, the power tower multi-gym machine is provided which incorporates a main chassis, fixed handles and grips, an arrangement of pulleys and cables that are continuously connected to a single set of three elastic bands connected to a collector, special waist and an ankle belt that allow multiple exercise motions. The exercises can be performed from various hanging, standing and flat parallel to the floor positions.

In the preferred embodiment, the power tower multi-gym machine consists of a steel frame, upper, mid and lower grips, upper and lower three spaced groove pulleys, upper and lower single pulleys, a single set of three elastic bands, an adjustable cable with hooks, and a special waist with front and back ring hangers. Also, an ankle accessory with a ring hanger is also required for different exercises.

Two sets of motion sensors consist of a receiver installed on the upper and lower part of the machine frame and a transmitter linked to the collector. The sensor counts the repetitions performed and sends them to a specific application on a smartphone device used as a gateway to collect and present data.

The smart phone specific application has user settings (body measurements: weight, height, neck, chest, biceps, etc. training objectives) predefined or customized exercises (type of exercise, number of sets, repetitions, pause time) gives the directives to the user to perform the exercise accordingly by showing schematic diagram and spoken voice instructions.

A cloud server then consolidates the user settings, predefined exercises and the performed exercises in order to compute the key indicators in terms of reached objectives, burnt calories, weight, BMI (Body Mass Index), motivational instructions, logs, history statistics over certain period of times, and ranking with other users.

To set the machine configuration, the user adjusts the required load/support by selecting the color coded elastic band, the number of the elastic bands (one, two or three) and attaches them to the collector. The user then puts on the special waist belt around his waist (related to the size of the user, and set only once for most of the exercises per user).

In case of a need to increase the load, the user attaches the ring of the adjustable strap of the waist belt to the lower hook of the collector cable and, in the inverse case, where the user wants to have a support for his weight, the user attaches the ring of the adjustable strap of the waist belt to the upper hook of the collector cable.

The collector cable is also adjustable in predefined positions for the exercises to be performed on the machine.

For chin ups or pullups, from a standing position facing forward, a user can grasp the grips fixed at the top of the chassis, put on his waist belt and start the exercise movement up and down.

For the chest exercise, from a parallel position to the floor, the user still facing the machine, adjusts the length of the collector cable, attaches it to the ring hangar attached to the belts strap, grasps the lower grips and starts the exercise movement up and down.

The machine gives a very large of variety of exercises using the different grips and the accessories.

The different angles of the upper grips can be grasped to perform pull-ups, chin-ups, for back and biceps.

The horizontal mid grips can be grasped to perform dips, for chest and triceps.

The vertical mid grip can be grasped and resting the forehand on the pad to perform leg raises and knee raises for abdominals.

The different lower grips to perform inclined inner and outer push-ups for chest and shoulders.

Without any grip, only with the waist belt put on the user, other exercises can also be performed such as crunches and sit-ups for abdominal, lung, squat and a one-legged cable for legs.

A mix and match of the different grips, waist belt and accessories, such as an ankle belt, leads to a very large variety of movement the user would like to perform, such as plank, stretching, etc.

Indeed, the machine allows for virtually unlimited training motions at any position by simply using the user's body weight with the elastic bands, which will be apparent from the disclosure contained herein to a person skilled in the relevant art.

These and other features and advantages of the invention will be apparent upon consideration of the following detailed description of the presently preferred embodiments of the invention, taken in conjunction with the claims and appended drawings, as well as will be learned through the practice of the invention.

DESCRIPTION OF THE PREFERRED EMBODIMENTS

Figure 1:
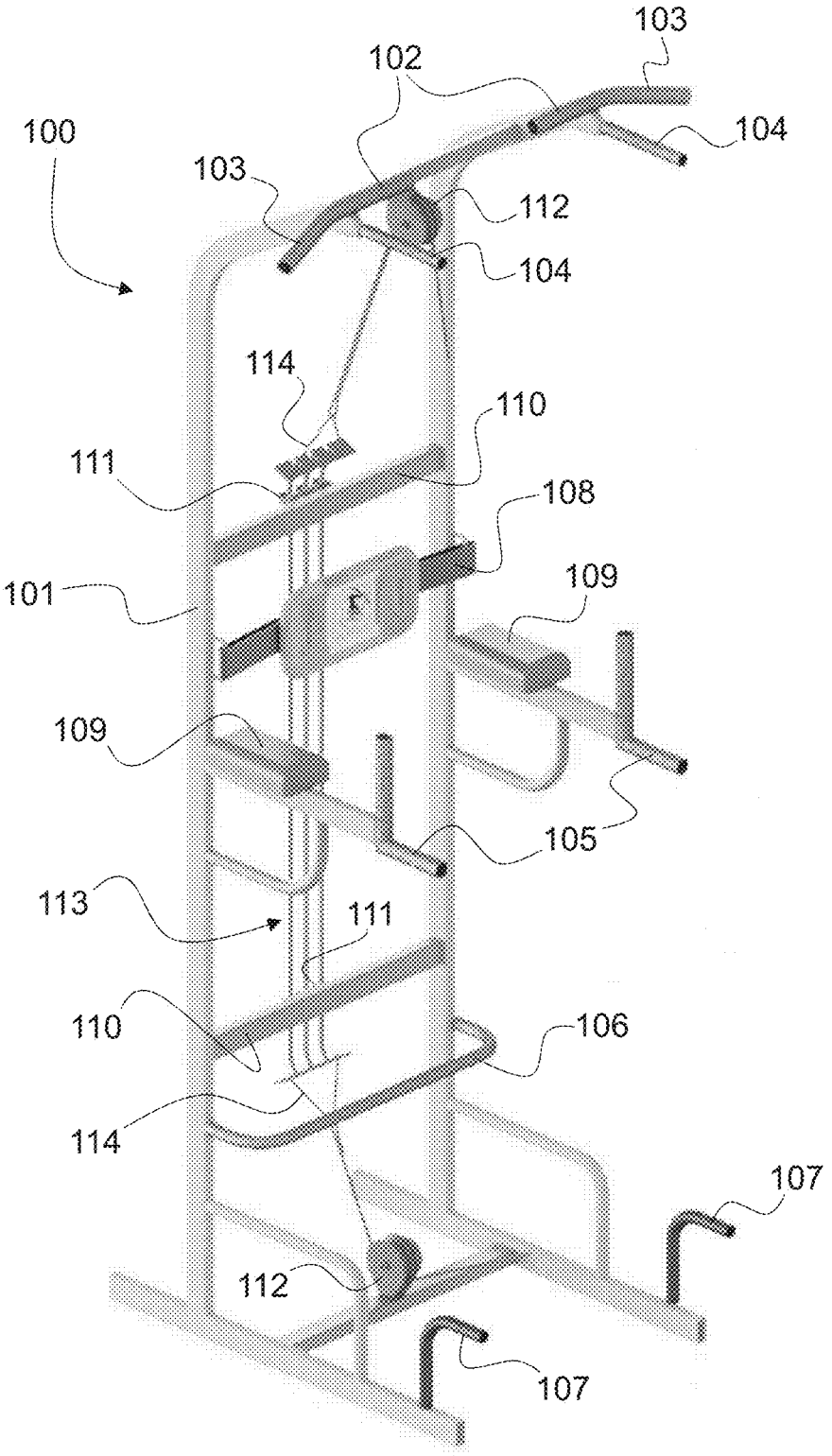
FIG. 1 is a perspective isometric view of the power tower multi-gym machine incorporating a multiple pulley system in accordance with an embodiment of the present invention.

While the invention can be embodied in many different forms, there is shown in the drawings, and will herein be described in detail, a preferred embodiment of the present invention with the understanding that the present disclosure is to be considered as an exemplification of the principles of the invention and is not intended to limit the invention to the embodiments illustrated herein.

Referring now to FIGS. 1-8, various views of the power tower multi-gym machine, which is designated general by the reference character 100, are shown. In accordance with one aspect of the invention, the power tower multi gym machine 100 includes a steel chassis, grips linked to the chassis, forehand rest pad, pulley system incorporating two one-groove pulleys, two three-groove pulleys, three elastic bands attached to collector, and flexible wire, adjustable strap ending with a hook, waist belt with front and back hook ring. The group of the elastic bands, collector, adjustable straps, and hook are shown in more detail in FIG. 2. The waist belt is illustrated in more details in FIG. 3. These components will be described in more detail below.

The frame of the power tower multi-gym machine 100 includes a main steel chassis 101, the handle grips 102, 103, 104, 105, 107 with anti-slip texture (covered with foam pad in higher variants), and leg support 106 covered with foam pad (in all variants) are welded/bolted together to the main steel chassis 101 in a manner known in the art. The pulley system consists of the pulley frame 110 welded to the main steel chassis 101. The upper and lower one-groove V shape pulleys 112 and upper and lower three-groove U shape pulleys 111 are bolted to pulley frame 110 in order to enable free swiveling.

A back support wide strap made of fabric 108 is attached to the steel chassis 101 by means of four holes in the corners of the fabric to be hanged to four pins fixed on the chassis in a manner that is well known in the art.

A forehand pad 109 filled with semi rigid foam is bolted to the steel chassis 101.

For the purpose of the present invention, the elastic bands 113 used in this invention have a tubular shape. A desired set tension may be reached by selecting the color-coded elastic band and the combination of the number of bands. The elastic bands may be provided as a set of elastic tubes that have different colors: e.g. yellow, green, red and blue, with each color corresponding to a different resistance. One or two or three elastic bands can be attached to the two collectors 114 by pulling the cable, which decrease its thickness and squeezing the terminal of the elastic band 113 (shown in FIG. 2).

Figure 2:
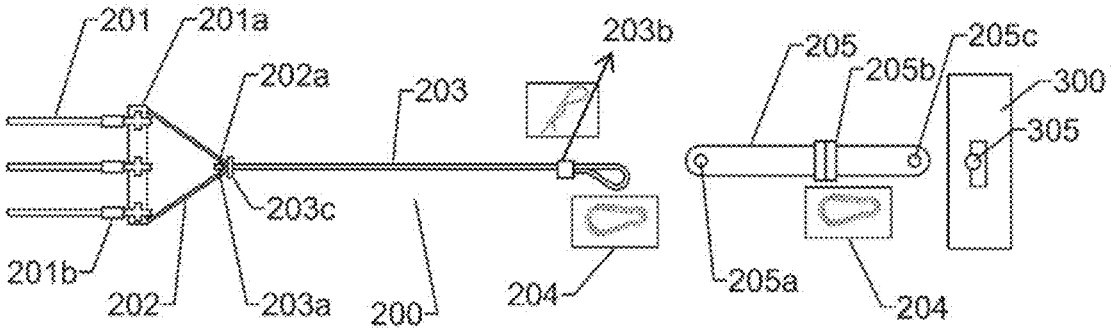
FIG. 2 is a perspective view of the elastic cables, the collector and the hook in accordance with an embodiment of the present invention.

The construction of the cable system 200 is described herein and illustrated in FIG. 2. In both ends of each elastic band 201 there is an integrated bulk of rubber 201*a* to be placed in to the collector 202 by pulling and squeezing the terminal 201*b* of the elastic band.

The collector 202 made of lightweight aluminum has three tight grooves enabling the fixation of the elastic band. On the other side of the collector 202, a steel wire 203 crosses the middle of the collector through a hole 202*a* and is stopped by a washer 203*c* fixed to the wire 203. The wire's end is fixed to the collector by means of the threaded shape in the end of the wire 203 tightened with a nut 203*a*

On the other side of the wire 203, a knothole 203*b* is created by means of folding and tightening the wire.

The adjustable strap 205 is fabricated from nylon fabric with two ends 205*a* and 205*c* in the form of a keyhole. A buckle 205*b* is regulating the length of the double folded strap 205.

The snap hook 204 is used to connect the knot hole 203*b* with the adjustable strap end 205*a*

Figure 3:
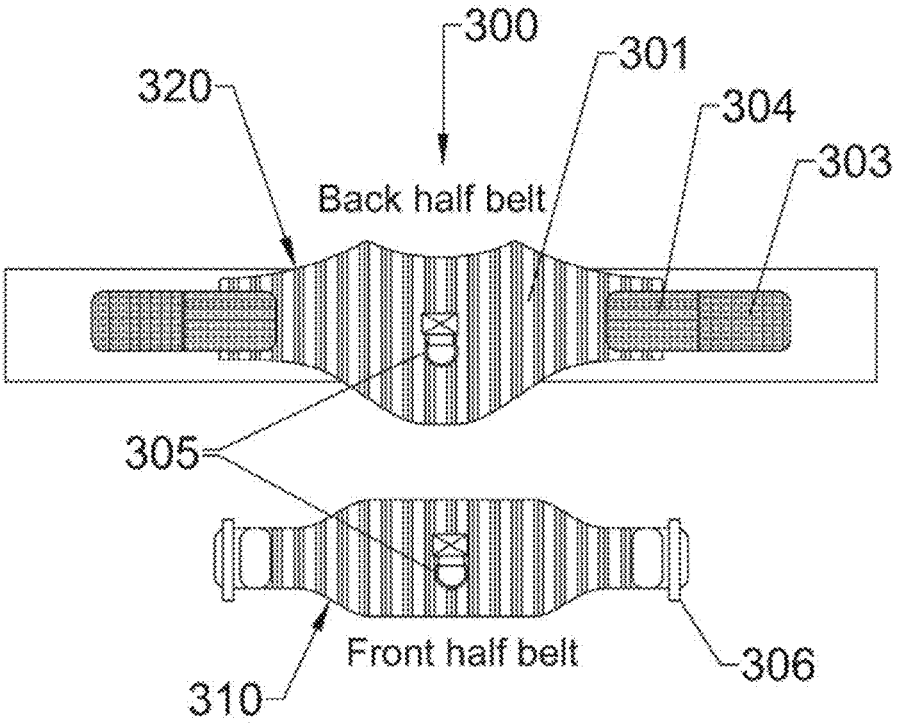
FIG. 3 is a perspective isometric view of the waist belt and the D ring hangar in accordance with an embodiment of the present invention.

FIG. 3 shows the details of the belt 300 which includes two half sides, front 310 and back 320.

The two halves are fabricated from nylon fabric, padded with a thin layer of foam reinforced with stainless steel stays 301 similar to the collar stays.

An independent neoprene rubber belt is attached back to back to the inner side of the belt back half 320 by means of adherence strap.

Two D-rings 305 are stitched to the outer side of the two half belts 310 and 320.

The back half belt 320 includes two adherence straps on both ends consisting of male adherence surface 303 and female adherence surface 304.

In order to connect the two half belts 310 and 320, the male adherence strap 303 is slipped through the buckle 306 attached to the front half belt 310, then pulled to fit the waist size of the user then folded and put on the female adherence surface 304.

Figure 4:
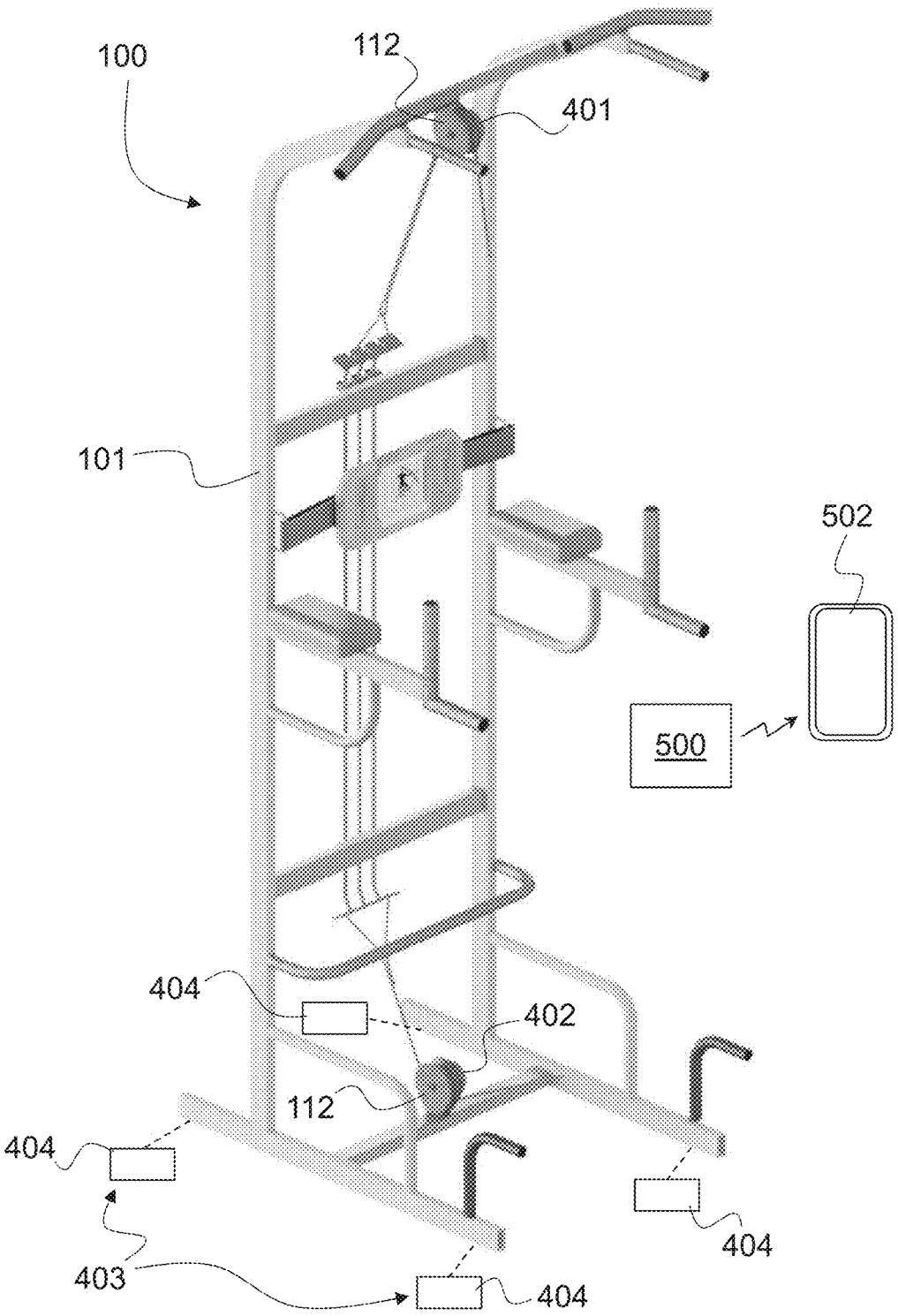
FIG. 4 is a perspective isometric view of the sensors mounted on the power tower multi-gym machine in accordance with an embodiment of the present invention.

The electronic sensors module attached to the machine 100 is fully illustrated in FIG. 4. Two angular movement encoders 401 and 402 mounted on the upper and lower one-groove pulleys 112.

A weighing steel platform 403 is attached to the bottom of the chassis 101, on which the user stand to measure his or her weight. Four load sensors 404 are located beneath the four legs of the chassis.

All these sensors are connected to a state-of-the-art processor 500 with Bluetooth communication to send the processed information to the mobile phone device 502.

Figure 5:
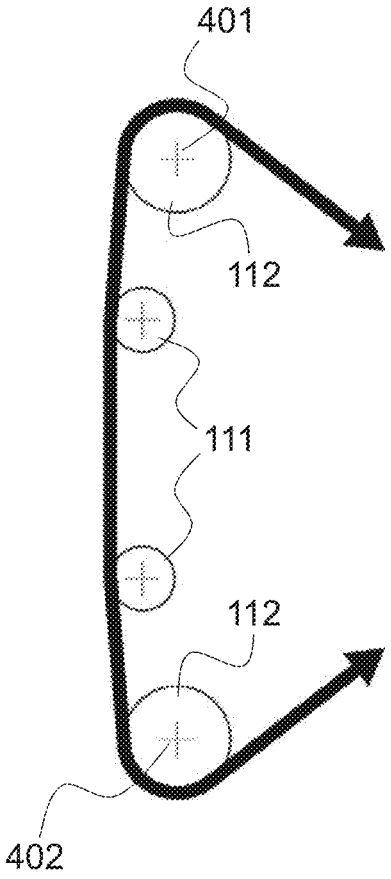
FIG. 5 is a perspective side view of the elastic band, steel wire, the pulleys and the mounted encoder on the pulleys in accordance with an embodiment of the present invention.

FIG. 5 illustrates the angular movement encoders 401 and 402 mounted on the upper and lower one-groove pulleys 112. The encoders measure the angular movement of the elastic band in factor of the pulley diameter translated into different signals, i.e., the start and the end of the exercise, the numbers of repetitions and the rest time in between.

Figure 6:
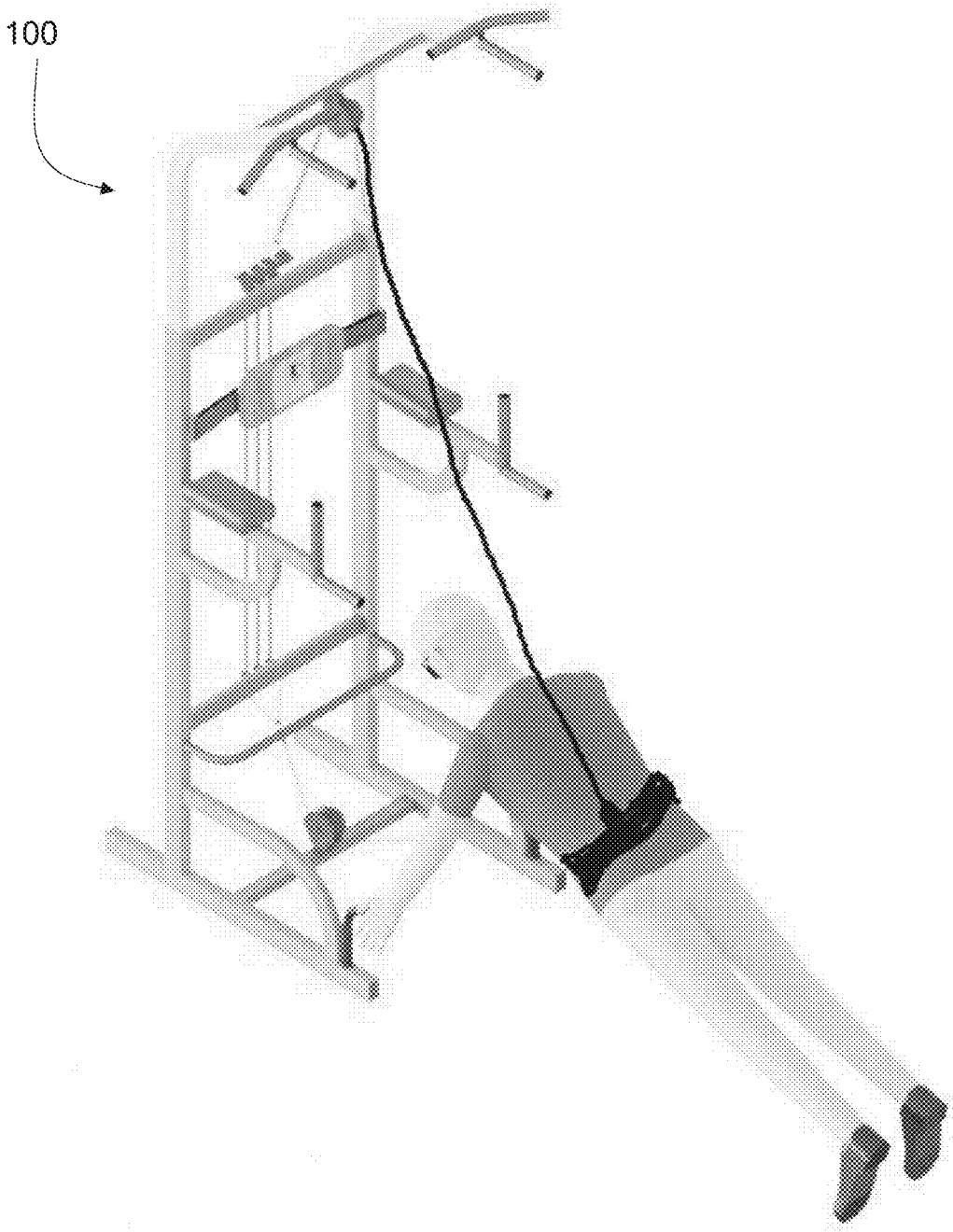
FIG. 6 is a perspective isometric view of a user using the power tower multi-gym machine in combination with the waist belt assembly to perform push-up workout with assistance function, in accordance with an embodiment of the present invention.

FIG. 6 illustrates the push-up exercise performed in the mode of additional support by means of connecting the harness to the cable from above.

Figure 7:
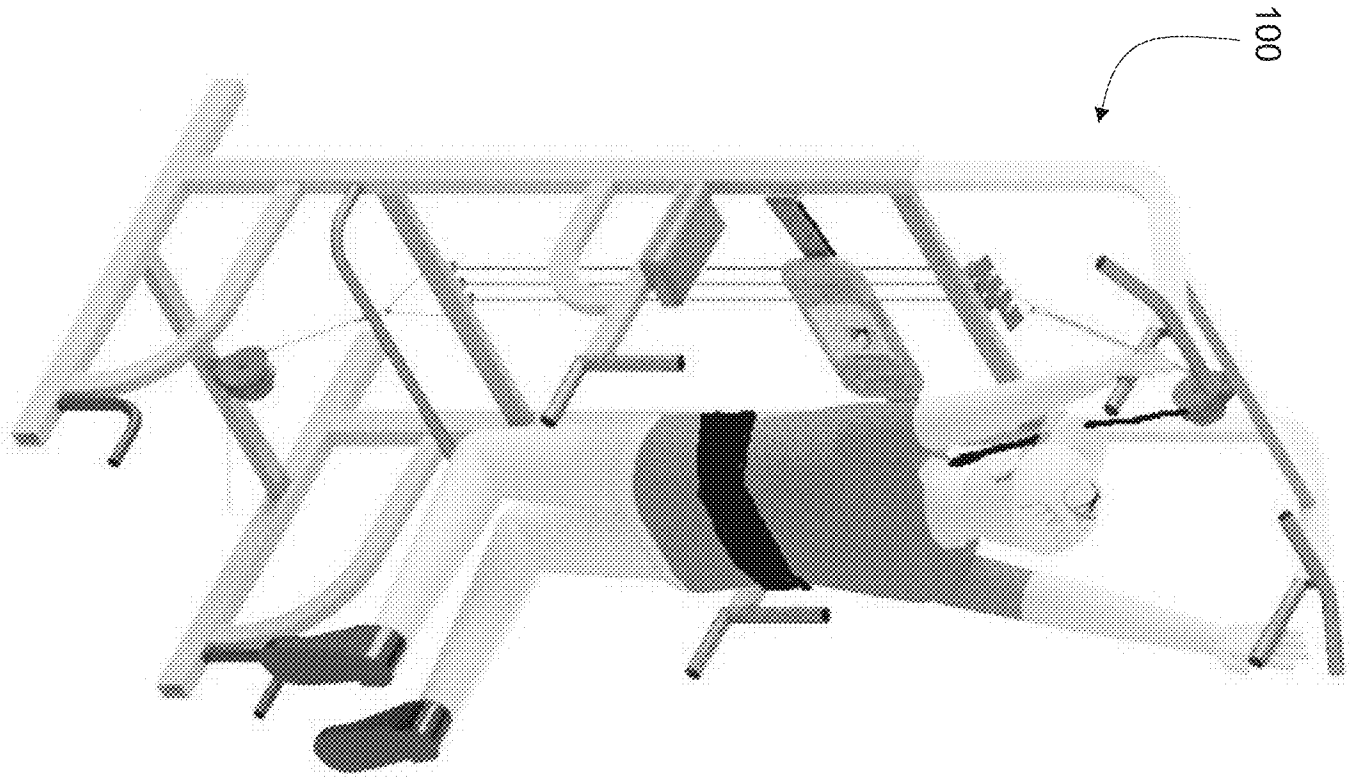
FIG. 7 is a perspective isometric view of a user using the power tower multi-gym machine in combination with the waist belt assembly to perform pull-up workout with resistance function, in accordance with an embodiment of the present invention.

FIG. 7 illustrates the push-up exercise performed in the mode of additional resistance by means of the connection of the harness to the cable from below.

Figure 8:
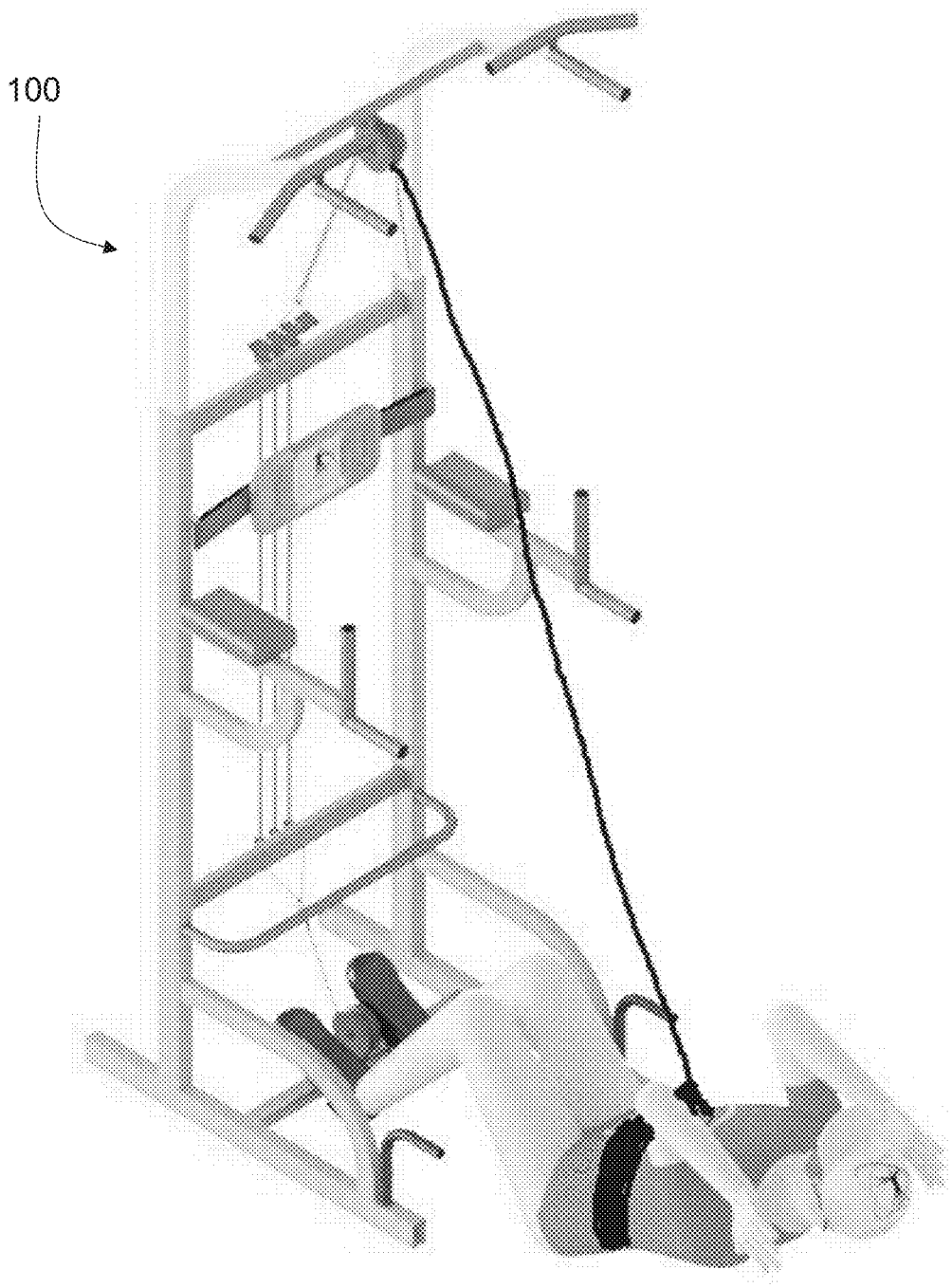
FIG. 8 is a perspective isometric view of a user using the power tower multi-gym machine in combination with the waist belt assembly to perform crunch workout with assistance function, in accordance with an embodiment of the present invention.

FIG. 8 illustrates the crunch exercise in the mode additional support by means of connecting the cable from above.

It is to be understood that a wide range of changes and modifications to the embodiments described above will be apparent to those skilled in the art, and these changes and modifications are contemplated herein. It is, therefore, intended that the foregoing detailed description be regarded as illustrative rather than limiting, and that it be understood that it is the following claims, including all equivalents, that are intended to define the spirit and scope of the invention.

The invention claimed is:

1. A power tower multi-gym machine, comprising:

a frame;

a set of handle grips and pads attached to the frame and providing different positions of exercise;

an upper one-groove pulley attached to an upper portion of the frame;

an upper three-groove pulley attached to a mid-upper portion of the frame;

a lower one-groove pulley attached to a lower portion of the frame;

a lower three-groove pulley attached to a mid-lower portion of the frame;

a group of elastic bands providing assistance and resistance to exercise motion, wherein the group of elastic bands is functionally engaged with the upper and lower three-groove pulleys;

upper and lower collectors attached at both ends of the group of elastic bands;

an upper steel wire attached at one end to the upper collector and functionally engaged with the upper one-groove pulley;

a first hook attached to another end of the upper steel wire;

a lower steel wire attached at one end to the lower collector and functionally engaged with the lower one-groove pulley;

a second hook attached to another end of the lower steel wire; and a waist belt configured to be selectively coupled to the first or second hook.

2. The power tower multi-gym machine as defined in claim 1, wherein said group of elastic bands is sliding only on the upper and lower three-groove pulleys.

3. The power tower multi-gym machine as defined in claim 1, wherein the upper and lower three-groove pulleys are U-shaped groove pulleys.

4. The power tower multi-gym machine as defined in claim 1, wherein the upper and lower steel wires are sliding only on the upper and lower one-groove pulleys.

5. The power tower multi-gym machine as defined in claim 1, wherein the upper and lower one-groove pulleys are V-shaped groove pulleys.

6. The power tower multi-gym machine as defined in claim 1, further comprising an adjustable strap configured to couple the waist belt to the first or second hook.

7. The power tower multi-gym machine as defined in claim 1, wherein the waist belt consists of two halves comprising a front half and a back half, which are attached together around a waist of the user.

8. The power tower multi-gym machine as defined in claim 7, wherein the front and back halves of the waist belt are attached together by two adherence straps comprising male and female adherence surfaces.

9. The power tower multi-gym machine as defined in claim 7, wherein the waist belt further comprises one D-ring on the front half and one D-ring on the back half for attachment to the first or second hook.

10. The power tower multi-gym machine as defined in claim 7, wherein the front and back halves are reinforced with stainless steel stays.

11. The power tower multi-gym machine as defined in claim 7, wherein the waist belt further comprises a neoprene belt attached to an inner side of the waist belt for fostering fat burning on the waist area.

12. The power tower multi-gym machine as defined in claim 1, wherein the upper and lower one-groove pulleys are linked to encoders to measure movement of the upper and lower steel wires.

13. The power tower multi-gym machine as defined in claim 12, wherein the encoders are connected to a microprocessor and transmission unit for communication to a mobile phone device.

14. The power tower multi-gym machine as defined in claim 1, further comprising an integrated weighing platform including four load sensors fixed underneath four legs of the power tower multi-gym machine.

15. The power tower multi-gym machine as defined in claim 14, wherein the load sensors are connected to a microprocessor and transmission unit for communication to a mobile phone device.

* * * * *